United States Patent [19]

Kishi et al.

[11] Patent Number: 4,951,360

[45] Date of Patent: Aug. 28, 1990

[54] TOP-COMB DRIVE MECHANISM FOR COMBING MACHINE

[75] Inventors: Katsutoshi Kishi, Hashima; Shigeyuki Tachi, Tsushima; Kazuhiro Inagaki, Kuwana; Yoshinori Saruwatari, Nagoya, all of Japan

[73] Assignee: Howa Machinery, Ltd., Japan

[21] Appl. No.: 377,578

[22] Filed: Jul. 10, 1989

[30] Foreign Application Priority Data

Jul. 14, 1988 [JP] Japan ..... 63-175671

[51] Int. Cl.[5] ..... D01G 19/16

[52] U.S. Cl. ..... 19/225; 19/235

[58] Field of Search ..... 19/215, 223, 225, 227, 19/228, 232, 235

[56] References Cited

U.S. PATENT DOCUMENTS

| | | | |
|---|---|---|---|
| 1,466,346 | 9/1923 | Nasmith | 19/225 |
| 1,473,197 | 11/1923 | Nasmith | 19/225 |
| 1,605,135 | 11/1926 | Nasmith | 19/228 |
| 2,572,122 | 10/1951 | Dudley et al. | 19/225 |
| 3,320,643 | 5/1967 | Katori | 19/225 |
| 4,295,249 | 10/1981 | Sibmon | 19/225 |
| 4,672,717 | 6/1987 | Shimomura | 19/225 |

FOREIGN PATENT DOCUMENTS

| | | |
|---|---|---|
| 384715 | 11/1981 | Japan . |
| 60-194125 | 10/1985 | Japan . |
| 60174425 | 8/1986 | Japan . |
| 478260 | 10/1969 | Switzerland . |
| 222436 | 2/1971 | United Kingdom . |

*Primary Examiner*—Werner H. Schroeder
*Assistant Examiner*—Michael A. Neas
*Attorney, Agent, or Firm*—Stevens, Davis, Miller & Mosher

[57] ABSTRACT

A top-comb driving mechanism applied to a conventional combing machine, wherein cycles of forward amd rearward reciprocal swinging displacing motions of a nipper body of each combing head are carried out, is provided with a motion transmission mechanism each one round rotation of a driving shaft in synchronism with a combing cylinder to each top-comb holding arms in a condition such that the reciprocal upward and downward swinging motion of a top-comb holding arm is created so that the above-mentioned forward end rearward reciprocal swinging displacing motion of the nipper body is combined with the above-mentioned reciprocal upward and downward swinging motion of the top-comb holding arms of each combing head, whereby each top-comb is reciprocally displaced along a locus of a forward displacement thereof which is a gentle convex curve directed slightly downward, and displaced along a locus of a rearward displacement thereof which is a gentle concave curve directed slightly upward, between a front terminal point of the forward displacement motion and a rear terminal point, located a little higher than the front terminal point, of a rearward displacing motion thereof.

5 Claims, 5 Drawing Sheets

TOP-COMB DRIVE MECHANISM FOR COMBING MACHINE

BACKGROUND OF THE INVENTION

1. Field of the Invention

The present invention concerns a top-comb drive mechanism applied to a high speed comber and characterized by a very high number of nips of more than 250 to 350/minute.

2. Description of the Related Arts

To clarify the purpose of the present invention, first the problems of the high-speed comber for which a solution is required by the cotton spinning industry will be explained, and thereafter, the various technical advances that have been made in an effort to solve these problems will be described.

In the conventional combing machine, it is well known that the top comb is usually moved along an identical moving locus during the forward and rearward displacements thereof. In such a combing machine, to ensure a satisfactory combing action by the top comb, preferably the working time of the top comb is such that the combing action time is long enough that the combing action is started as early as possible during each cycle thereof. Nevertheless, if the starting time of the combing action of the top-comb is early, a top comb of the combing mechanism may work on a front edge portion of a fringe at which a unit combing action by a combing cylinder has been completed, in a condition such that the front edge portion of the combed fringe is not completely gripped by the detaching rollers, i.e., a timing just before the piecing operation of the forward edge portion of the combed fringe with the rearward edge portion of the fleece gripped by the detaching rollers is commenced. As the result of this action of the top-comb, fibers useful for producing a yarn may be removed as "waste fiber', and further, a folding of the front edge of fibers in the combed fringe may occur, which will cause an irregular piecing of the combed fringe with the rearward edge portion of the fleece gripped by the detaching rollers. To eliminate this drawback, if the starting time of the combing action by the top-comb is retarded, the working time of the combing action is shortened, and thus the combing action applied to the rearward portion of the fleece is not sufficient, i.e., short fibers and impurities in the fleece can not be completely removed, and accordingly, a desirable combing action by the top-comb can not be obtained.

To solve the above-mentioned problem, Japanese Examined Patent Publication No. 38-4715 (1963) discloses that the upwards and downwards motion of the top-comb be carried out by applying a locus of the forward and rearward displacing motions of the top-comb, wherein the locus of the forward displacing motion thereof is different from the locus of the rearward displacing motion thereof. According to this invention, the forward end portion of the combed fringe is gripped by the detaching rollers so that the combed fringe is displaced forward while providing a draft in the zone between the nip point of the detaching rollers and the nip point between the cushion plate and the feed roller, and the top-comb is rapidly inserted into the fleece to which the above-mentioned draft is applied. Accordingly, a forward displacement of the portion of the fleece upstream from the position at which the top-comb is inserted is disturbed, and accordingly, an irregular draft is created and a high speed drive of the combing machine can not be carried out.

In Japanese Unexamined Patent Publication No. 60-194125 (1985), the applicant of the present patent application proposed an improvement of the mechanism of the apparatus disclosed by the above-mentioned Japanese Examined Patent Publication No. 38-4715. In this apparatus, the top-comb is guided by a combined outside contacting cam surface formed by a movable cam and a stationary cam so that the top-comb is moved along a locus of a forward displacement thereof and a locus of a rearward displacement which is different from the locus of forward displacement, to eliminate the above-mentioned drawback of the apparatus disclosed by Japanese Examined Patent Publication No. 38-4715. This improved mechanism, however, has the following drawbacks, i.e., since in this apparatus, a cam ball is contacted from the outside of the guide-cam surface formed by the combination of two guide-cam surfaces wherein one surface thereof is the cam-surface of the movable cam, it is necessary to provide a detachable device for this movable cam, and thus it is impossible to drive the combing machine at a speed faster than 250 nips/minute. A very loud noise due to the displacing motion of the cam ball between the above-mentioned two cam surfaces also creates a problem in the working environment of spinning factories. Moreover, when the motion of top-comb must be adjusted to conform to changes of the raw material, etc., the adjustment must be applied to each combing head one by one, separately, and such an adjusting operation incurs a longer down time for maintenance of the combing machine concerned.

SUMMARY OF THE INVENTION

To solve the above-mentioned drawback of the known drive mechanism of the top-comb driving mechanism, in the present invention, a pair of top-comb holding arms are swingably mounted on a nipper body at both sides of each combing head, which can be moved forward and rearward by a motion of a nipper shaft, a motion transmission mechanism is arranged between a rotation shaft, which is driven synchronously with the rotation of a combing cylinder, such as a combing shaft or a horizontal shaft arranged in parallel to the combing shaft and rear ends of the corresponding one of the top-comb holding arms, respectively, in such a way that an end of a connecting rod forming a part of the motion transmission mechanism is pivotally connected to the rear end of each top-comb holding arm and a free end of another connecting arm of the motion transmission mechanism is connected to the corresponding one of gear-end side or outer-end side of the above-mentioned rotation shaft while biased from the axial center of the rotation shaft according to a predetermined index. Therefore, the forward and rearward displacing motion of the nipper body by the nipper shaft and the upward and downward swing motion of the top-comb holding arm created by the motion transmission mechanism based upon the rotation of the rotation shaft are combined so that the top-comb is reciprocally displaced along a locus for a forward displacement thereof, which is a gentle convex curve directed slightly downward, and displaced along a locus for a rearward displacement thereof which is a gentle concave curve directed slightly upward, between a front terminal of the forward displacement motion thereof and a rear terminal, located at a position slightly higher than the front terminal, of the rearward displacing motion thereof, so that the combing action is carried out under a desirable condition at a predetermined timing.

As a practical top-comb driving mechanism according to the present invention, where the motion transmission mechanism is directly connected to the cylinder shaft, the following design must be adopted, because of possible interference due to the general mechanism of the combing machine, i.e., an intermediate shaft is turnably mounted to the combing machine in a condition such that the intermediate shaft extends from the gear-end to the outer-end of the combing machine in parallel to the cylinder shaft, and the above-mentioned motion transmission mechanism is designed to involve two parts, i.e., a crank mechanism arranged between the above-mentioned intermediate shaft and either one of the gear-end side or outer-end side of the cylinder shaft, in such condition that each one of the crank mechanism is provided with a pair of connecting rods turnably connected to each other at their one-ends, one of which is rigidly mounted another end thereof to the intermediate shaft, and another free end of the other connecting rod of the crank mechanism is connected to the corresponding one of the gear-end side or the outer-end side of the cylinder shaft in biased condition from the axial center of the cylinder shaft at a position corresponding to a predetermined index. And a pair of link mechanisms are arranged between the top-comb holding arms of each combing head in a condition such that one connecting arm of each link mechanism is turnably connected to the rear end of the corresponding top-comb holding arm via the horizontal shaft, and another connecting arm of the link mechanism is rigidly connected to the above-mentioned intermediate shaft, so that the above-mentioned desirable motion of the top-comb can be created. On the other hand, an additional horizontal rotation shaft, which is driven synchronously with the cylinder shaft and extended from the gear-end to the outer-end of the combing machine, is disposed in the combing machine, and another horizontal shaft, parallel to the cylinder shaft, is disposed in the combing machine in a condition such that this horizontal shaft passes through all top-comb holding arms at the rear ends thereof, and one of the above-mentioned crank mechanism systems is arranged between the additional rotation shaft and the above-mentioned horizontal shaft, to create the above-mentioned desirable motion of the top-comb.

DESCRIPTION OF THE PREFERRED EMBODIMENTS

It is well known that a conventional combing machine to which the present invention is applied is provided with a plurality of combing heads having an identical mechanism, but the explanation of the preferred embodiment of the top-comb drive mechanism according to the present invention is mainly directed to only one combing head.

Figure 1:
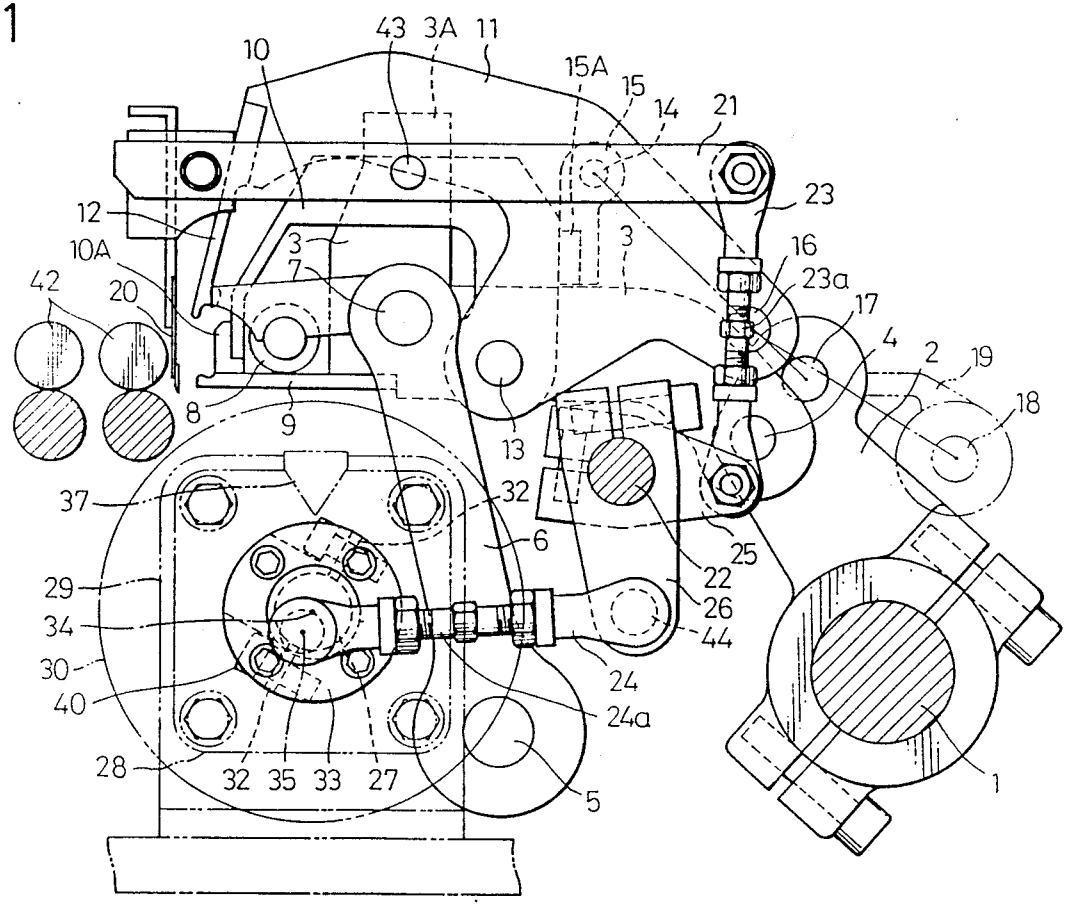
FIG. 1 is a partly sectional side view of the top-comb drive mechanism of an embodiment of the combing machine according to the present invention, wherein the top-comb is located at the terminal point of the forward displacing motion thereof.

Referring to FIG. 1, a rear end terminal portion of a nipper body 3 is turnably connected to a pair of nipper drive levers 2, which are secured to and face a nipper shaft 1, by a pin 4 mounted horizontally to the nipper drive levers 2, and a forward end terminal portion of the nipper body 3 is turnably connected to a pair of branch rods 6, which are freely mounted on a branch shaft 5 while facing each other, by a horizontal pin 7. A cushion plate 9 is fixed to a forward end portion of the nipper body 3 in a substantially horizontal condition and a feed roller 8 is rotatably disposed thereon. A pair of auxiliary nipper arms 10, which one facing each other and rigidly hold an auxiliary horizontal nipper 10A at their forward ends, are pivotally mounted on the corresponding pins 13 projected from the nipper body 3, and on the other side, a pair of nipper knife arms 11, which hold a nipper knife 12 at the forward end portions thereof, are also pivotally mounted on the corresponding one of the above-mentioned pin 13. A horizontal bar 15A is rigidly held by the rear end of the auxiliary nipper arms 10, and a stopper arm 15 having a stopper pin 14 planted thereon is disposed at the bar 15A while a horizontal stopper pin 16 is rigidly held by the respective rear ends of the nipper knife arms 11. A horizontal stopper pin 17 is rigidly held by the nipper drive lever 2 and another horizontal stopper pin 18 is mounted on an arm rod 19 disposed at a frame of the combing machine concerned. A mechanism for opening and closing the auxiliary nipper 10A to the cushion plate 9 is disposed between the stopper pins 14 and 17, while another mechanism for opening and closing the nipper knife 12 to the cushion plate 9 is disposed between the stopper pins 16 and 18. These mechanisms are well known conventional mechanisms utilizing a spring force, and since these mechanisms are disclosed in detail in Japanese Unexamined Patent Publication No. 61-174425 (1986), an explanation thereof is omitted. To facilitate understanding of these mechanisms, they are indicated by a dash-dot lines connecting the stopper pins in FIGS. 1 and 2.

In the mechanism of the top-comb drive mechanism of this embodiment described above, when the nipper shaft 1 is actuated, the nipper body 3, the auxiliary nipper arms 10, and the nipper knife arms 11 move with predetermined forward and rearward motions at their own strokes, so that the auxiliary nipper 10A and the nipper knife 12 are respectively opened and closed at predetermined timings.

Next, the drive mechanism of the top-comb 20, which is the essential point of the present invention is explained in detail with reference to FIGS. 1, 2, 3, 4, 5, and 6.

As shown in FIG. 1, a pair of top-comb holding arms 21 are pivotally mounted to corresponding pins 43 secured to respective branch brackets 3A projected upwards from the nipper body 3 at both sides thereof, and a top comb 20 is detachably mounted to the forward end portions of the top-comb holding arms 21. An intermediate shaft 22 is disposed at a lower position of the nipper body 3 and extends along the entire longitudinal length of the combing machine, and is rotatably disposed at the combing machine concerned. A pair of second connecting rods 25 are rigidly mounted to the intermediate shaft 22 at the respective positions of each combing head and facing the corresponding top-comb holding arms 21 of each combing head, a pair of first connecting rods 23, each provided with a length adjusting mechanism such as a turn-buckle 23*a*, are pivotally connected at the one free ends thereof to the rear end of the corresponding top-comb holding arms 21. A fourth connecting rod 26 is rigidly secured to the intermediate shaft 22 at both-side ends of the intermediate shaft 22 and the third connecting rod 24 is arranged between the fourth connecting rod 26 and the corresponding end of a cylinder shaft 27 in such way that the end of the fourth connecting rod 24 is connected to the corresponding end side of the cylinder shaft 27 in a biased condition from the axial center of the cylinder shaft 27, and the free end of third connecting rod 24 is pivotally connected to the free end of the corresponding fourth connecting rod 26. Accordingly, the above-mentioned mechanism provided with the first connecting rod 23 and the second connecting rod 25 forms a link mechanism, and the above-mentioned mechanism provided with the third connecting rod 24 and the fourth connecting rod 26 forms a crank mechanism.

The mechanism created by the combination of the above-mentioned link motion mechanism with the above-mentioned crank mechanism corresponds to the motion transmission mechanism which was mentioned in the previous paragraph "Summary of the invention'.

The mechanism and the function thereof are hereinafter explained in more detail.

Figure 4:
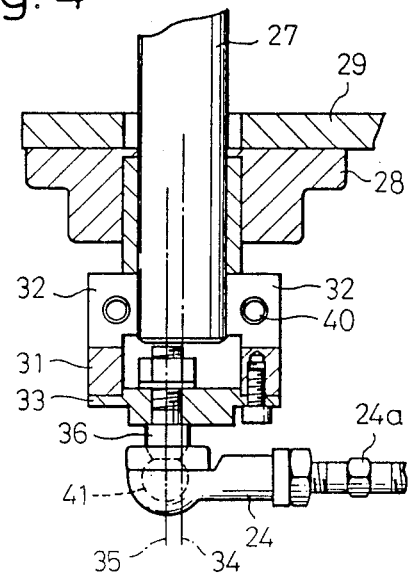
FIG. 4 is a sectional view of the mechanism shown in FIG. 3.

As shown in FIG. 4, the cylinder shaft 27 is rotatably held by brackets 28 to a machine frame 29, and the conventional combing cylinder 30 is mounted on the cylinder shaft 27. A hollow cylindrical body 31, which is provided with two slits 32, is detachably mounted on the cylinder shaft 27 at one end portion thereof which corresponds to the side of the fourth connecting rod 26 secured to the intermediate shaft 22, by a set screw 40. As is well known, an index plate (not shown) whereon 8 hallmarks are stamped with a die on the circumference thereof at identical angular intervals according to 40 identical angular divisions is provided, and accordingly, the motion of each mechanical element, for example, the reciprocal forward and rearward displacing motion of the nipper body 3, can be indicated by a hallmark of the index plate to which a mark indicator disposed at the machine frame is directed. In this embodiment, the index (hallmark) 40 shows a condition of the nipper body 3 such that the nipper body is located at the forward motion terminal thereof (shown in FIG. 1) and index (hallmark) 17 shows that the nipper body 3 is located at the rearward motion terminal thereof (shown in FIG. 2). A holding plate 33 having a size almost identical to the cross-section of the hollow cylindrical body 31 is rigidly mounted on the side of the hollow cylindrical body 31 by four setting screws, and a setting shaft 36 of a third connecting rod 24 is mounted on the holding plate 33 in a condition such that an axial center of the setting shaft 36 is biased by a predetermined distance from an axial center 35 of the holding plate 33, which coincides with the axial center 34 of the cylinder shaft 27.

Figure 3:
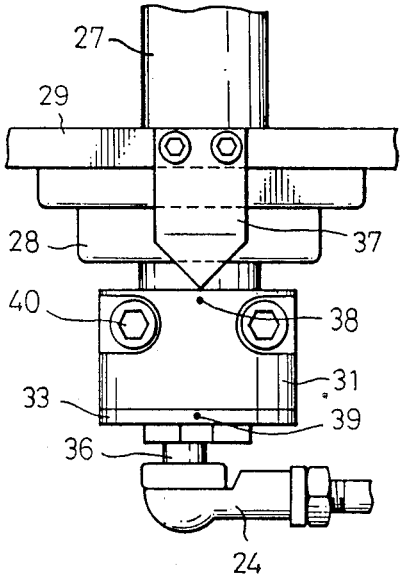
FIG. 3 is an elevation view of the disposing mechanism of the third connecting rod of the top-comb driving mechanism shown in FIG. 1.
Figure 5:
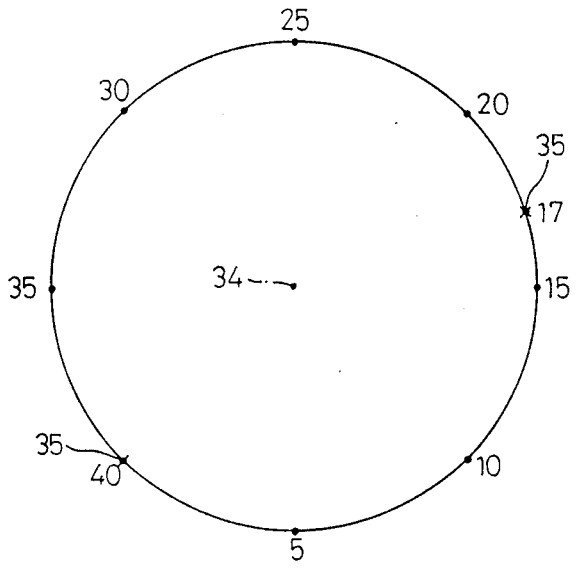
FIG. 5 is a diagram indicating the index utilized for the top-comb drive mechanism shown in FIG. 1.
Figure 6:
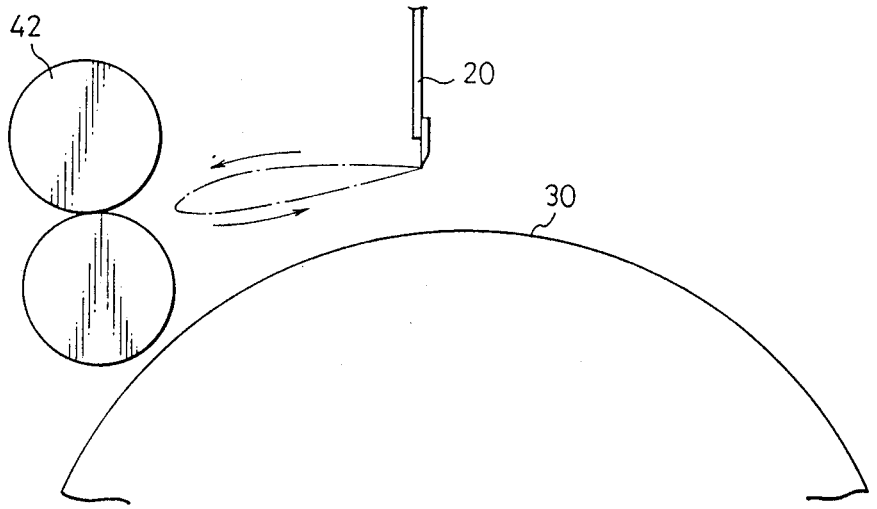
FIG. 6 is an explanatory drawing indicating an example of a locus of a tip point of the top-comb, applied to the top-comb drive mechanism shown in FIG. 1.

The angular setting position of the hollow cylindrical body 31 to the cylinder shaft 27 is such that, when the nipper body 3 arrives at the forward terminal of the forward motion thereof, which position coincides with the index 40, i.e., the biased position of the axial center 35 is located on a line indicating the index 40 which is defined by an angle of 135 degrees to a vertical line passing the axial center 34 in the counterclockwise direction in FIG. 5, or when the nipper body 3 arrives at the rearward terminal of the rearward motion thereof, which coincides to the index 17 which coincides with the index 17 i.e., the biased position of the axial center 35 is located on a line indicating the index 17 which is defined by an angle of 72 degrees to the vertical line passing the axial center 34 in the clockwise direction in FIG. 5. In FIG. 5, the biased positions of the axial center 35 to a corresponding line passing through the axial center 34, which lines indicate the corresponding index, are marked with a die at each of five graduations by a numerical expression like the index marks. Therefore, the position of each numeral 5 to 40 indicates the biased position of the axial shaft 35 at the respective time points of the corresponding index. To confirm the standard biased setting point of the hollow cylindrical body 31 and facilitate an easy adjustment of the motion of the top-comb 20, an indication member 37 is disposed at the machine frame 29, and markings 38 and 39 are made at the respective predetermined positions on the hollow cylindrical holding body 31 and the holding plate 33, respectively, as shown in FIG. 3. When the hollow cylindrical holding body 31 is mounted on the cylindrical shaft 27 while facing these markings 38 and 39, the arrangement relationship between the hollow cylindrical body 31 and the holding plate 33, and the axial center of the cylinder shaft 27 and the axial center 35, are automatically fixed as shown in FIG. 5. One end of the third connecting rod 24, which is provided with the turn-buckle 24*a* like the first connecting rod 23, is connected to the setting shaft by a spherical bearing 41, like a universal joint. On the other hand, the fourth connecting rod 26 is connected to the other end of the third connecting rod 24 by a pivot shaft 44 mounted on the fourth connecting rod 26 as a free joint, so that a crank mechanism is constructed as mentioned above. Accordingly, each top-comb holding arm 21 of the top-comb 20 is connected to the cylinder shaft 27 by the above-mentioned motion transmission mechanism, and the rotation of the cylinder shaft 27 is transmitted to each holding arm 21 of the top-comb 20, as a reciprocal upward and downward swing motion thereof in combination of reciprocal forward and rearward displacing motion of the nipper body 3.

The drive of the top-comb 20 of the above-mentioned embodiment is hereinafter explained in detail.

Figure 2:
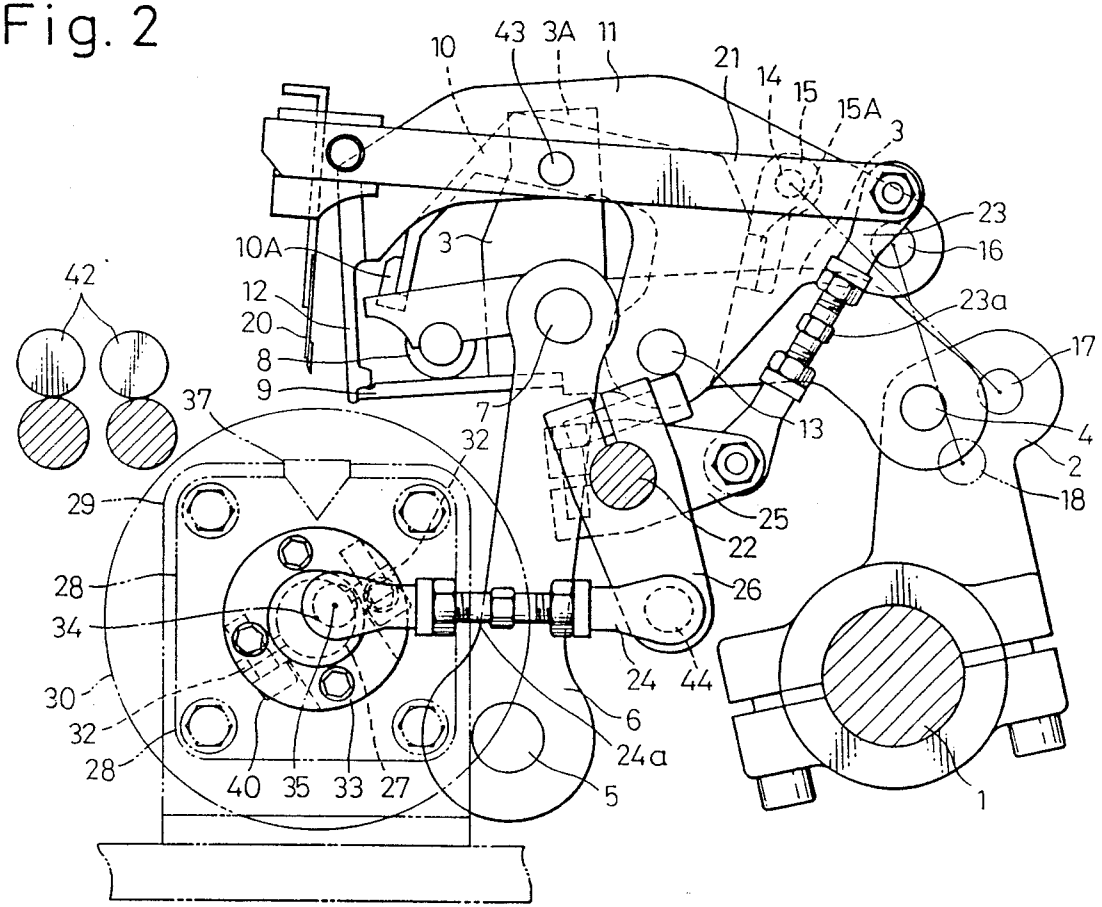
FIG. 2 is a partly sectional side view of the top-comb drive mechanism of the combing machine shown in FIG. 1, wherein the top-comb is located at the terminal point of the rearward displacing motion thereof.

When the nipper body 3 in each combing head is at the terminal point of the rearward displacement thereof, each holding arm 21 of the top-comb 20 is at a position shown in FIG. 2, the axial center 35 of the setting shaft 36 is at a position indicated by the index 17 as shown in FIG. 5, and the top-comb 20 is at an elevated position at the terminal point of the rearward displacement thereof.

Accordingly, when the nipper body 3 is moved towards the terminal point of the forward displacement thereof, due to the drive of the nipper shaft 1 (FIG. 1), the top-comb 20 is also moved forward, and the fulcrum points of the holding arms 21 with the corresponding first connecting rods 23 are also moved forward. According to the displacement of the above-mentioned fulcrum points, the top-comb 20 is displaced downward to a predetermined position so that the top-comb 20 is displaced along a gentle downward curved locus toward the terminal point of the forward displacement thereof. When the nipper body 3 is moved forward as mentioned above, the nipper knife 12 and the auxiliary nipper 10A operate as follows. Namely, the auxiliary nipper 10A, which was open to the cushion plate 9, is closed at a predetermined timing by a mechanism for opening and closing the auxiliary nipper 10A, to the cushion plate 9 not shown in the drawings of this application, and the nipper knife 12, which was closed to the cushion plate 9, is opened, so that the fringe, which was subjected to the combing action of the combing cylinder 30, is released from the action of the nipper knife 12. During the forward displacing motion of the nipper body 3, the detaching rollers 42 are driven in the direction in which the combed fleece, which was subjected to the previous combing action, is fed back, and when the feedback length of the combed fleece reaches a predetermined value, the detaching rollers 42 are returned in their normal angular direction to deliver the combed fleece from the combing machine. During the above-mentioned operation of the combing machine, the nipper body 3 is moved further forward, and when the nipper body 3 approaches the terminal point of the forward displacement thereof, the forward end potion of the combed fringe, which is combed by the combing cylinder 30, is fed onto a fleece which is first fed back and then displaced forward at a high speed by the rotation of the detaching roller in the direction in which the continuous fleece is delivered from the combing machine, so that the above-mentioned combed fringe is gripped by the detaching rollers 42, whereby the piecing operation of the fringe to the fleece from the detaching rollers 42 is carried out.

The above-mentioned operations are identical to the operation of the conventional combing machine, but the drive mechanism of the top-comb 20 is operated as follows.

As mentioned above, when the nipper body 3 is moved in the forward direction, the top-comb 20 is moved downward, and when the nipper body 3 is located at the terminal point of the rearward displacement thereof (FIG. 2), the axial center 35 of the setting shaft 36 of the third connecting rod 24 is axially positioned at an angular position corresponding to the index 17, as shown in FIG. 5. The setting shaft 36 is turned in the counter-clockwise direction (FIG. 5) about the axial center 34 of the cylinder shaft 27, according to the rotation of the cylinder shaft 27, and since the relationship between the axial center 34 of the cylinder shaft 27 and the axial center 35 of the setting shaft 36 of the third connecting rod 24 is maintained a relationship like a crank rod of a crank mechanism, the above-mentioned rotation of the axial center 35 about the axial center 34 creates the reciprocal normal and reverse angular turning motion with a predetermined angle of the intermittent shaft 22 via the third connecting rod 24 and the fourth connecting rod 26, and further, transmits this reciprocal angular turning motion to the top-comb holding arms 21 of the top-comb 20 to create an upward and downward reciprocal swing motion thereof, via the second connecting rod 25 and the first connecting rod 23. Namely, since the driving motion of the cylinder shaft 27 and the forward movement of the nipper body 3 are carried out synchronously, when the nipper body 3 is located at the terminal point of the rearward displacement thereof, the axial center 35 of the setting shaft 36 of the third connecting rod 24, which is located at a position corresponding to the index 17, turns about the axial center 34 of the cylinder shaft 36 in the counterclockwise direction in FIG. 5. As clearly shown in FIG. 5, during the turning operation of the axial center 35 about the axial center 34 to the position corresponding to the index 35 (FIG. 5), the third connecting rod 24 is pulled to the left in FIG. 1 so that the intermediate shaft 22 is turned in the clockwise direction, and the above-mentioned turning motion of the intermittent shaft 22 is transmitted to the respective top-comb holding arms 21, whereby the rear end of each arm 21 is displaced downwards, and accordingly, the top-comb 20 is displaced upward to a predetermined higher position.

Nevertheless, if the amount of the above-mentioned elevation of the top-comb 20 is compared with the amount of downward displacement of the top-comb 20 according to the forward displacement of the nipper body 3, since the latter is larger than the former, during the forward displacement motion of the top-comb 20 toward the terminal point of this motion, the top-comb 20 is moved downward by an amount corresponding to the result of subtracting the amount of downward displacement of the top-comb 20 from the amount of elevation of the top-comb, along the gentle downward slope shown in FIG. 1. Due to the forward movement of the top-comb 20 while being displaced downward, when the top-comb 20 arrives at a position adjacent to the terminal point of the forward displacement thereof, and the axial center 35 of the setting shaft 36 of the third connecting rod 24 is turned about the axial center 34 to the angular position corresponding to the index 35, the motion of the top-comb 20 is changed to the following mode. Namely, as shown in FIG. 5, the action of the third connecting rod 24, which has acted to elevate the top-comb 20 until this time, is changed to displace the top-comb 20 downward, the top comb 20 is moved forward while moving more rapidly downward compared to the previous downward movement, due to the result of a combination of the above-mentioned action of the third connecting rod 24 and the downward action created by the forward displacing motion of the nipper body 3. According to the above-mentioned motion of the top-comb driving mechanism, when the upstream end portion of the combed fringe combed by the combing cylinder 30 is gripped by the detaching roller 42, and then the piecing of the fringe to the downstream end of the fleece fed back to the side of cushion plate 9 by the detaching rollers 42 is carried out, the top-comb 20 is synchronously inserted into the fleece to thereby start the combing action. Then the nipper body 3 is moved slightly forward together with the top-comb 20 so that the top-comb 20 arrives at the terminal point of the forward displacement thereof, and the axial center 35 of the setting shaft 36 of the third connecting rod 24 reaches at angular position corresponding to the index 40 (FIG. 1). As mentioned above, the top-comb 20 is inserted into the fleece just before the top-comb 20 arrives at a terminal point of the forward displacement thereof, and the top-comb 20 is moved slightly forward immediately after the insertion thereof into the fleece. Since the delivery speed of the fleece by the detaching roller is faster than the speed of the forward displacement motion of the top-comb 20, no problems arise when carrying out the combing operation of this embodiment.

As mentioned above, when the nipper body 3 arrives at the terminal point of the forward displacement thereof, the nipper shaft 27 is actuated in a reverse direction to that of the previous motion so that the nipper body 3 is displaced rearward and accordingly, the top comb 20 is elevated, conversely to the previous downward motion. The turning motion about the axial center 34 of the combing cylinder 6 of the axial center 35 of the holding shaft 36 of the third connecting rod 24 is carried out to move the top-comb 20 downward until the axial center 35 turns about the axial center 34 from the position corresponding the index 40 to the position corresponding the index 15. During the turning motion of the axial center 35, since the amount of elevation of the top-comb 20 created by the motion of the crank mechanism system is larger than the amount of downwards displacement of the top comb 20 due to the forward displacement of the nipper body 3, the top-comb 20 is displaced upward while maintaining the insertion thereof into the fleece, while the top-comb 20 is displaced to the rearward direction, so that the top-comb 20 is moved rearward along the gentle upward curved locus. Accordingly, the top-comb 20 combs the fleece, which is subjected to the drafting operation between the detaching rollers 42 and the nip point between the feed roller 8 and the cushion plate 9, and short fibers and impurities such as waste, etc., remaining in a rear-side portion of the fleece, which was not removed by the combing action of the combing cylinder 6, are removed by the successive combing action by the combing cylinder 3. The above-mentioned combing action by the top-comb 20 during the combination of the upward motion and the rearward motion thereof is continued until the fleece, which is subjected to the above-mentioned drafting action, is separated by the further rearward motion of the nipper body 3. Thereafter, the top-comb 20 is moved rearward while moving upward, and when the axial center 35 of the holding shaft 36 of the third connecting rod 24 is turned around the axial center 34 to pass the position corresponding to the index 15, as is clear from FIG. 4, the function of the third connecting rod 24, which has acted to move the top-comb 20 downward, is changed to elevate the top-comb 20 upward, and thereafter, the top-comb 20 is moved rearward while rapidly moving upward, so that the top-comb 20 is returned together with the nipper body 3 to the terminal point of the rearward displacement thereof. During the rearward displacement motion of the nipper body 3, the nipper knife 12, which is closed to the cushion plate 9, is opened at a predetermined timing, and the auxiliary nipper 10A, which is closed to the cushion plate 9, is also opened, and thus one cycle of the combing operation is completed. Thereafter, the above-mentioned unit cycle of the combing operation is repeated.

In the above embodiment, the adjustment of the combing operation by the top-comb 20 is carried out as follows. In the above embodiment of the present invention, when the top-comb 20 (nipper body) is located at a terminal point of the rearward displacement thereof, the combing operation is carried out such condition, when the top-comb 20 (nipper body 3) is located at a terminal point of the rearward displacement thereof, the axial center 35 of the holding shaft 36 of the third connecting rod 24 is located at an angular position corresponding to the index 17, while at the terminal point of the forward displacement of the top-comb 20, the top-comb 20 is located at the angular position corresponding to the index 40. When adjusting the combing operation according to a change of the spinning conditions, such as change of a blending ratio of the supplied raw cottons, it is well known that the time of commencing the combing action or time of finishing the combing action by the top-comb 20 in each cycle of a combing action by the top-comb 20, etc., is adjusted. In this adjusting operation in the conventional driving mechanism of the combing machine, each combing head must be adjusted separately, and this adjusting operation is a complicated manual operation and thus inevitably the down time of the spinning operation is prolonged. It must be further recognized that a uniform adjustment of the combing operation for every combing head is practically impossible. On the other hand, in the above embodiment according to the present invention, since the holding plate 33 to which the setting shaft 36 is rigidly engaged is secured to the side surface of the hollow cylindrical body 31, and the hollow cylindrical body 31 is detachably mounted to the cylinder shaft 27 by set-screws 40, the adjustment of all of the combing heads can be easily carried out in the following way manner; i.e., the set screws 40 are loosened so that the hollow cylindrical body 31 is turned relative t the cylinder shaft 27 in the clockwise or counterclockwise direction by watching the facing condition to the markings 37, 38 to find a desirable relationship between the holding cylindrical body 31 and the cylinder shaft 27, and then fixing the mounting of the holding cylindrical body 31 to the cylinder shaft 27 by the set screws 40. As mentioned above, once the above adjustment is carried out, the adjustment of all of the combing heads is completed. Moreover, since the length of the first connecting rod 23 and the length of the third connecting rod 24 can be adjusted by the turn-buckles **23*a* and 24, the moving locuses of the forward and rearward displacement of the top-comb 20** can be easily adjusted.

Finally, another embodiment of the present invention is briefly explained hereinafter. In the above first embodiment, the rotational motion of the cylinder shaft 27 is changed to a reciprocal swing motion by creating a crank mechanism by connecting the third connecting rod 24 to the cylinder shaft 27 in a biased condition, but such a motion transmission mechanism is not limited to utilizing the above-creation of a crank mechanism, and/or other transmission mechanism, for example, a utilization of an eccentric cam mechanism which can change a rotational motion to a reciprocal swing motion, etc., can be adopted. This condition is applied to the following second embodiment.

In the first embodiment of the present invention, the third connecting rod 24 is connected to the cylinder shaft 27 in a biased condition by way of the setting shaft 36 with respect to the axial center 34 of the shaft 27, and the motion of the cylinder shaft 27 is transmitted to the top-comb holding arms 21 respectively. In this modified embodiment, however, an additional drive shaft (identical to a drive shaft 122 in FIG. 7), which is synchronizing driven with the cylinder shaft 27, is mounted on the combing machine. This drive shaft, the intermediate shaft 22, and the top-comb holding arms 21 may be connected by connecting rods as in the first embodiment, respectively, to change the rotational motion of the cylinder shaft 27 to the reciprocal upward and rearward swing motion of the top-comb holding arms 21. Any one of the above mentioned mechanisms can be used according to the prevailing conditions, such as the arrangement of other machine-elements of the combing machine, the space for arranging the machine-elements, etc.

Figure 7:
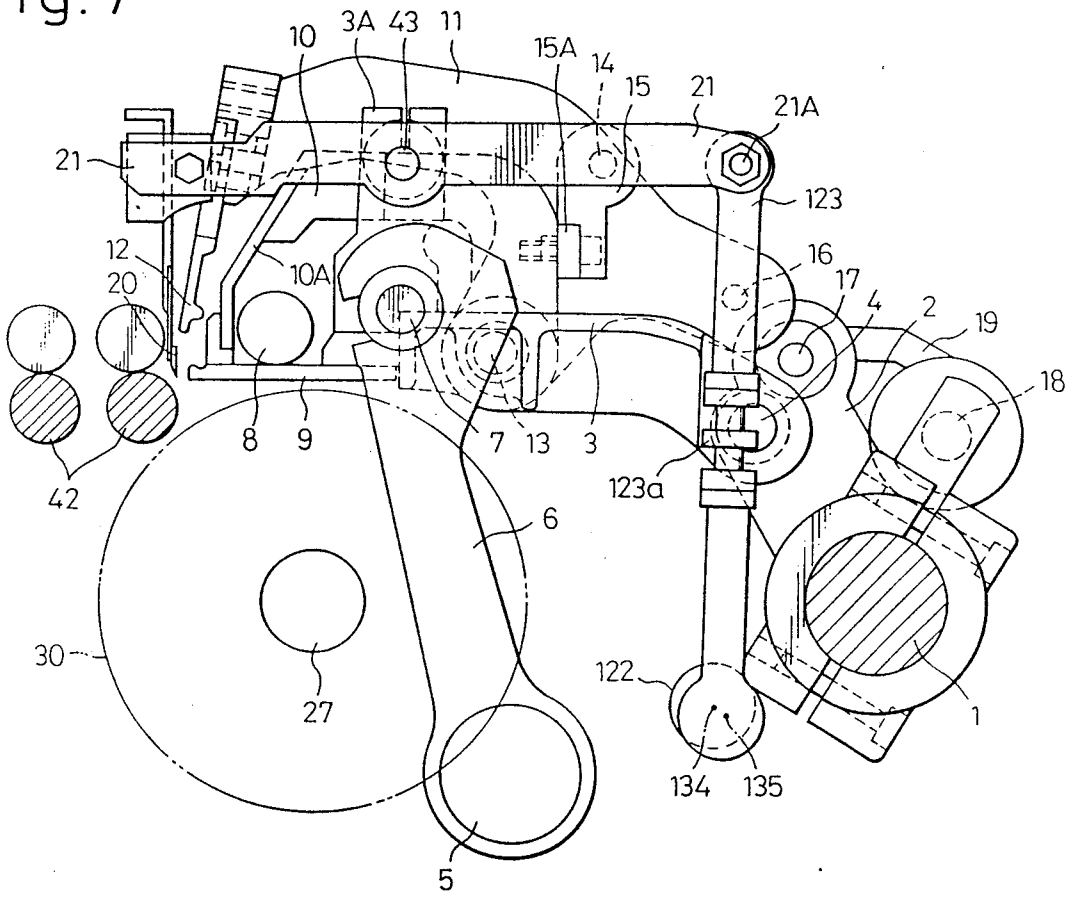
FIG. 7 is a partly sectional side view of another embodiment of the top-comb drive mechanism according to the present invention, wherein the top-comb is located at the terminal point of the forward displacing motion thereof.

Next, the second embodiment of the present invention is explained in detail with reference to FIG. 7. In this embodiment, an additional drive shaft 122 is mounted on the combing machine in parallel to the cylinder shaft 27. The shaft 122 extends to cover all combing heads of the combing machine and is driven in synchronization with the cylinder shaft 27 by a driving mechanism not shown. A horizontal shaft 21A extends to entire length of the combing machine to cover all combing heads in such condition that the shaft 21A passes through the rear ends of top-comb holding arms 21 of all combing heads. In each combing head, a pair of connecting rods 123 (hereinafter referred to as fifth connecting rods) are respectively connected to the additional drive shaft 122 and the connecting shaft 21A at the gear-end side and to the outer side of the combing machine, and each connecting rod 123 is provided with a length adjustable function by using a turn-buckle mechanism **123*a* as for the third connecting rods 23 and 24, respectively, in such a manner that the upper end of each fifth connecting rod 123 is pivotally connected to the corresponding one of the gear-end side or outer-end side of the connecting rod 21A, while the other end of each fifth connecting rod 123 is connected to the corresponding gear-end side or outer-end side of the drive shaft 122 in biased condition as follows. Namely, in this joint connection, the axial center of the pivotally connected portion of the fifth connecting rod 123 is biased from the axial center 134 of the drive shaft 122** at a predetermined distance, as in the first embodiment. Accordingly, in this embodiment, instead of carrying out the adjusting operation at only one side position (gear-end side or outer side of the combing machine) in the first embodiment, the adjusting operation must be carried out at the outer-end side and the gear-end side. Nevertheless, these two successive adjusting operations are very simple in comparison with the conventional top-comb driving mechanism of the conventional combing machine. The other advantages explained in the first embodiment are also satisfied in this second embodiment.

The above-mentioned crank mechanism also corresponds to the motion transmission mechanism mentioned in the previous paragraph "Summary of the invention'.

As explained above with regard to the preferred embodiment of the present invention, the pair of top-comb holding arms of each combing head are pivotally mounted to the nipper body of each combing head, and the rear ends of these top-comb holding arms are connected to a cylinder shaft or the additional drive shaft, which is synchronizingly driven to the cylinder shaft, by the motion transmission mechanism provided with a function of changing the rotational driving motion of the cylinder shaft or the additional drive shaft to the reciprocal upward and downward swing motion of the top-comb holding arms of all combing heads, in combination with the forward and rearward displacing motion of the nipper body of each combing head, whereby opposite upward and downward movement of the top comb due to the above-mentioned reciprocal motion of the nipper body is created synchronously to the above-mentioned reciprocal swing motion of the top-comb holding arm, so that the desirable reciprocal motion of the top-comb along a locus for a forward displacement and an other locus for a rearward displacement different which is different from the locus for forward displacement, and accordingly, when the piecing operation is carried out, the top-comb is inserted into the fleece while the fleece is moving forward according to the motion of the detaching rollers, so that the combing action by the top-comb is commenced. Therefore, the drawback of the conventional top-comb driving mechanism, due to the forward and rearward displacement motion of the top-comb along an identical locus, as pointed out in the preamble of this specification, can be effectively eliminated. Since the above-mentioned locus are gentle downward and upward curves, even when the top-comb is inserted into the fleece, the defect of the invention disclosed by the Japanese Examined Patent Publication No. 38-4715 (1963) can be eliminated. That is, the combing action by the top-comb applied to the fleece which is subjected to the drafting action due to the delivery action of the detaching rollers in the zone between the detaching rollers and the nip point between the feed roller and the cushion plate can be continued until the fleece is separated by the rearward motion of the nipper.

As already mentioned, when it is necessary to adjust the timing of the combing action, due to a change of the spinning condition, the adjustment operation can be easily carried out uniformly for all of the combing heads, and accordingly, this function is also a distinguishing advantage in comparison with the conventional top-comb driving mechanism of the conventional combing machine.

Another distinguishing advantage of the present invention is created by the simple and stable drive mechanism for actuating the top-comb which does not need such a cam mechanism provided with a circumscribed cam, movable cam, and engaging pawl detachable from the cam, etc., as used in the conventional top-comb driving mechanism of the conventional combing machine, because in the top-comb driving mechanism according to the present invention, a unique mechanism for changing the rotational motion of the cylinder shaft or the additional driving shaft to a reciprocal swing motion of the top-comb while moving it forward and rearward, according to the reciprocal forward and rearward displacement of the nipper body, wherein the rear end of the top-comb holding arm pivotally mounted on the nipper body is connected to the cylinder shaft or additional drive shaft, which is synchronously driven with the cylinder shaft, by the above-mentioned unique motion transmission mechanism, and accordingly the mechanical stability of the top-comb driving mechanism is superior to that of the known conventional mechanism and a speed of, e.g., 250 to 350 nip/minutes or higher can be practically applied without problems.

We claim:

1. A top-comb driving mechanism applied to a conventional combing machine provided with a plurality of combing heads, each combing-head being provided with a nipper body capable of carrying out unit forward and rearward reciprocal displacing motion cycles, a pair of top-comb holding arms turnably mounted on said nipper body and a combing cylinder for carrying out an action of said combing machine, comprising in combination, a mechanism for carrying out said reciprocal forward and rearward motion of said nipper body, a rotation shaft driven synchronously with said combing cylinder, a motion transmission mechanism for transmitting each one round rotation of said rotation shaft to each one of said top-comb holding arms in a form of one cycle of a upward and downward swinging motion of said top-comb holding arm synchronously with said forward and rearward displacing motion of said nipper body, whereby said forward and rearward reciprocal displacing motion of said nipper body is combined with said reciprocal upward and downward swinging motion of said top-comb holding arms, each top-comb is reciprocally displaced along a locus of a forward displacement which is a gentle convex curve directed slightly downward and then along another locus of a rearward displacement which is a gentle concave curve directed slightly upward, between a front terminal of said forward displacement of said top-comb and a rear terminal, located at a position a little higher than said front terminal, of said rear-ward displacement of said top-comb.

2. A top-comb driving mechanism applied to a conventional combing machine according to claim 1, further comprising an intermediate turnable shaft disposed between said combing cylinder and said arrangement of nipper bodies and extending from a gear-end to an outer-end of said combing machine, said shaft being parallel to said combing cylinder, said combing cylinder is rigidly mounted on a cylinder shaft, said motion transmission mechanism comprises a pair of link motion mechanisms arranged between said top-comb holding arms of each one of said combing heads and said intermediate shaft, and a crank mechanism arranged between said intermediate shaft and a corresponding one of gear-end or outer-end of said cylinder shaft, each of said link motion mechanisms is provided with a first connecting rod and a second connecting rod, said second connecting rod is pivotally connected to said first connecting rod at free ends thereof, the other free end of said first connecting rod is pivotally connected to a rear end of a corresponding one of said top-comb holding arms, and the other end of said second connecting rod is rigidly mounted to said intermediate shaft at a position corresponding to said top comb of said combing head, each one of said crank mechanism is provided with a third connecting rod and a fourth connecting rod which are pivotally connected to each other at the respective free ends thereof, the other free end of said third connecting rod is pivotally connected to a corresponding end-side of a gear-end or outer-end of said cylinder shaft while biased from the axial center of said cylinder shaft at a position corresponding to a predetermined index, and the other free end of said fourth connecting rod is rigidly mounted to said intermediate shaft at a position corresponding thereto.

3. A top-comb driving mechanism applied to a conventional combing machine according to claim 2, further comprising a horizontal pivot shaft passing through rear ends of all top-comb holding arms in parallel to said combing cylinder, wherein said rotation shaft is a rotation shaft additionally disposed in said combing machine in parallel to said combing cylinder, said rotation shaft extends from the gear-end to the outer-end of said combing machine, said motion transmission mechanism is provided with a pair of fifth connecting rods, each upper side free end of said fifth connecting rods is pivotally connected to a corresponding end of said horizontal pivot shaft, at corresponding one of said gear-end or outer-end of said combing machine, and the other free end of each fifth connecting rod is pivotally connected to a corresponding end-side of a gear-end or outer-end of said additional rotation shaft while biased from the axial center of said shaft at a position corresponding to a predetermined index, whereby a pair of crank mechanisms provided with said fifth connecting rods are formed at both sides of said additional shaft.

4. A top-comb driving mechanism applied to a conventional combing machine according to claim 2, wherein said third connecting rods are provided with length adjustable mechanisms.

5. A top-comb driving mechanism applied to a conventional combing machine according to claim 3, wherein said fifth connecting rod is provided with a length adjustable mechanism.

* * * * *